US010871347B1

(12) United States Patent
Yeates

(10) Patent No.: US 10,871,347 B1
(45) **Date of Patent: *Dec. 22, 2020**

(54) HOLSTER WITH ROTATABLE LOCKING ELEMENT

(71) Applicant: Sentry Solutions Products Group LLC, Virginia Beach, VA (US)

(72) Inventor: Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/532,024

(22) Filed: Aug. 5, 2019

Related U.S. Application Data

(63) Continuation of application No. 15/871,522, filed on Jan. 15, 2018, now Pat. No. 10,371,483.

(60) Provisional application No. 62/445,942, filed on Jan. 13, 2017.

(51) Int. Cl.
*F41C 33/00* (2006.01)
*F41C 33/02* (2006.01)

(52) U.S. Cl.
CPC ..... *F41C 33/0263* (2013.01); *F41C 33/0245* (2013.01)

(58) Field of Classification Search
CPC ..... F41C 33/0263; F41C 33/045
USPC ..... 224/243
See application file for complete search history.

(56) References Cited

U.S. PATENT DOCUMENTS 1,635,984 A * 7/1927 Corriston ..... F41C 33/0209 224/244
3,866,811 A * 2/1975 Hamby ..... F41C 33/0209 224/244
3,910,469 A * 10/1975 Baldocchi ..... F41C 33/0245 224/198
4,750,655 A * 6/1988 Barry ..... F41C 33/0227 224/243
4,971,236 A * 11/1990 Grummet ..... F41C 33/0209 224/193
5,275,317 A * 1/1994 Rogers ..... F41C 33/0209 224/244
5,449,103 A * 9/1995 Tilley ..... F41A 17/063 224/244
5,573,157 A * 11/1996 Mauriello ..... F41C 33/0263 224/244
5,810,221 A * 9/1998 Beletsky ..... F41C 33/0227 224/244

(Continued)

*Primary Examiner* — Peter N Helvey
(74) *Attorney, Agent, or Firm* — Shaddock Law Group, PC

(57) ABSTRACT

A locking holster having a side wall portion for receiving at least a portion of a handgun; a locking element with a locking projection extending from a helical ramp surface of the locking element, a central aperture is formed through the locking element with one or more flute guide projections extending into the central aperture; and a release bar having a flute portion with one or more spiral or helical grooves formed therein to interact with at least a portion of the flute guide projections, such that slidable movement of the release bar relative to the locking element produces rotational movement of the locking element, and wherein at least a portion of the locking projection retains the handgun in the holster in an engaged position, via interaction between at least a portion of the locking projection and an interior surface of a trigger guard of the handgun.

20 Claims, 14 Drawing Sheets

(56) References Cited

U.S. PATENT DOCUMENTS

| | | | | |
|---|---|---|---|---|
| 5,961,013 | A * | 10/1999 | Collins | F41C 33/0227 224/244 |
| 6,276,581 | B1 * | 8/2001 | Glock | F41C 33/0263 224/244 |
| 6,398,089 | B1 * | 6/2002 | Har-Shen | F41C 33/0209 224/192 |
| 6,752,300 | B2 * | 6/2004 | Har-Shen | F41C 33/0209 224/244 |
| 9,658,031 | B1 * | 5/2017 | Hedeen | F41G 1/35 |
| 2002/0158095 | A1 * | 10/2002 | Vor Keller | E05B 47/0603 224/244 |
| 2003/0141331 | A1 * | 7/2003 | Liu | F41C 33/0209 224/244 |
| 2004/0050887 | A1 * | 3/2004 | Spielberger | F41C 33/0245 224/244 |
| 2004/0195282 | A1 * | 10/2004 | Beletsky | F41C 33/0209 224/244 |
| 2006/0226185 | A1 * | 10/2006 | Har-Shen | F41C 33/0209 224/244 |

* cited by examiner

HOLSTER WITH ROTATABLE LOCKING ELEMENT

CROSS-REFERENCE TO RELATED APPLICATIONS

This patent application claims the benefit of U.S. patent application Ser. No. 15/871,522, filed Jan. 15, 2018, which claims the benefit of U.S. Patent Application Ser. No. 62/445,942, filed Jan. 13, 2017, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of holsters. More specifically, the presently disclosed systems, methods, and/or apparatuses relate to a holster with a rotatable locking element and release bar disengagement adaptable to be used with a handgun or other firearm.

2. Description of Related Art

It is generally known to carry a handgun in a holster designed to protect the handgun and hold it securely. Holsters can be worn in a number of ways, such as on a belt at the waist, on the thigh, attached or coupled to a plate carrier or tactical vest, under an arm, or around an ankle.

In certain instances, a handgun must be secured or retained within the holster, but quickly and easily removed from the holster, regardless of the type of holster used. Additionally, users need to be assured that, when not in use, the handgun will remain safely in the holster.

Some holsters rely solely on friction to secure the handgun in place. This combination might not be suitable for situations where the gun/holster is subject to a great deal of movement because such movement could cause the handgun to lose frictional engagement with the holster.

Certain other holsters include a variety of strap or flap arrangements that prevent the removal of the firearm from the holster while the strap or flap is in place. With designs that rely on this method to retain a handgun, a user must first unfasten and/or rotate the strap/flap before the firearm can be withdrawn. Then, to re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

Still other types of holsters include a release lever that is attached or coupled to the holster body so as to pivot, about a pivot pin or fulcrum point.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical locking holster arrangements have various shortcomings.

In order to overcome the shortcomings of the currently known locking holster arrangements and/or to provide an improved Holster with Rotatable Locking Element. In various exemplary, non-limiting embodiments, the locking holster of the presently disclosed systems, methods, and/or apparatuses comprises a holster body defining an at least partial cavity portion for receiving at least a portion of a handgun therein; a locking element, wherein the locking element extends from a proximal end to a distal end, wherein a helical portion, defining a helical ramp surface, extends to a locking projection extending from at least a portion of the distal end of the locking element, wherein a central aperture is formed through the locking element, wherein one or more flute guide projections extend at least partially into the central aperture, wherein the locking element is positioned within at least a portion of the holster body, wherein the locking element is at least partially rotatable between a locked position and an unlocked position; and an elongate release bar, wherein the release bar extends from a first end to an initial portion, a flute portion, an extension portion, and a second end, wherein one or more spiral or helical flutes are formed in the flute portion, wherein the spiral or helical flutes are formed so as to receive at least a portion of the flute guide projections therein, such that as the flute guide projections interact with the spiral or helical flutes, slidable movement of the release bar relative to the locking element results in rotational movement of the locking element, wherein when the locking element is positioned such that the flute guide projections are positioned along the extension portion, the locking element may rotate relative to the extension portion, wherein at least a portion of the release bar is slidably positioned within at least a portion of the holster body such that the release bar is repeatably slidable between a neutral position and an engaged position relative to the holster body, and wherein at least a portion of the locking projection retains the handgun in the holster in the engaged position, via interaction between at least a portion of the locking projection and an interior surface of a trigger guard of the handgun, and permits release of the handgun when the locking element is in the unlocked position.

In various exemplary, nonlimiting embodiments, the locking holster further comprises a release lever attached or coupled to the second end of the release bar.

In various exemplary, nonlimiting embodiments, the locking holster further comprises a locking element securing element proximate the second end of the release bar to keep the second end of the release bar from being withdrawn from the central aperture of the locking element.

In various exemplary, nonlimiting embodiments, the holster body comprises a pair of opposed wall portions comprising a first wall portion and a second wall portion and a pair of opposed wall portions comprising a third wall portion and a fourth wall portion.

In various exemplary, nonlimiting embodiments, the holster body comprises a single, continuous wall portion or multiple coupled or joined wall portions.

In various exemplary, nonlimiting embodiments, the at least partial cavity portion includes a holster trigger guard portion shaped so as to receive and accommodate at least a portion of the trigger guard of an inserted handgun.

In various exemplary, nonlimiting embodiments, the locking element comprises a substantially cylindrical or conical portion of material.

In various exemplary, nonlimiting embodiments, the helical ramp surface is a helical recess or a helical protrusion.

In various exemplary, nonlimiting embodiments, the helical ramp surface extends between the proximal end and the distal end.

In various exemplary, nonlimiting embodiments, the helical ramp surface is formed in or around at least a portion of the locking element.

In various exemplary, nonlimiting embodiments, the helical ramp surface provides an incurved rim that curves around at least a portion of the locking element.

In various exemplary, nonlimiting embodiments, the helical ramp surface generally follows a spiral or a curve along a portion of the locking element.

The locking holster of claim 1, wherein at least a portion of the release bar is positioned within a portion of a release bar channel formed in or through at least a portion of the holster body.

In various exemplary, nonlimiting embodiments, the locking element is positioned within at least a portion of the holster body such that the locking element substantially maintains its position relative to the longitudinal axis of the holster body.

In various exemplary, nonlimiting embodiments, the locking element is positioned at least partially within a holster recess.

In various exemplary, nonlimiting embodiments, if the locking element is in the lock position, at least a portion of the locking projection of the locking element protrudes into the at least partial cavity portion a sufficient distance to extend inside at least a portion of the trigger guard of the handgun if the handgun is seated within the at least partial cavity portion of the holster.

In various exemplary, nonlimiting embodiments, the release lever is biased to the neutral position.

In various exemplary, nonlimiting embodiments, the locking element is biased to the locked position.

In various exemplary, non-limiting embodiments, the locking holster of the presently disclosed systems, methods, and/or apparatuses comprises at least one side wall portion for receiving at least a portion of a handgun; a locking element, wherein a helical ramp surface extends to a locking projection extending from at least a portion of the locking element, wherein a central aperture is formed through the locking element, wherein one or more flute guide projections extend at least partially into the central aperture, wherein the locking element is at least partially rotatable between a locked position and an unlocked position within the at least one side wall portion; and a release bar having a flute portion and an extension portion, wherein one or more spiral or helical flutes are formed in the flute portion, wherein the spiral or helical flutes are formed so as to interact with at least a portion of the flute guide projections, such that as the flute guide projections interact with the spiral or helical flutes, slidable movement of the release bar relative to the locking element produces rotational movement of the locking element relative to the release bar between the locked position and the unlocked position, wherein when the locking element is positioned such that the flute guide projections are positioned along the extension portion, the locking element may rotate relative to the extension portion, wherein at least a portion of the release bar is slidably positioned within at least a portion of the side wall portion such that the release bar is repeatably slidable between a neutral position and an engaged position relative to the side wall portion, and wherein at least a portion of the locking projection retains the handgun in the holster in the engaged position, via interaction between at least a portion of the locking projection and an interior surface of a trigger guard of the handgun, and permits release of the handgun when the locking element is in the unlocked position.

In various exemplary, non-limiting embodiments, the locking holster of the presently disclosed systems, methods, and/or apparatuses comprises at least one side wall portion for receiving at least a portion of a handgun; a locking element having a locking projection extending from a helical ramp surface of the locking element, wherein a central aperture is formed through the locking element having one or more flute guide projections extend at least partially into the central aperture; and a release bar having a flute portion, wherein one or more spiral or helical grooves are formed in the flute portion to interact with at least a portion of the flute guide projections, such that as the flute guide projections interact with the spiral or helical grooves, slidable movement of the release bar relative to the locking element produces rotational movement of the locking element relative to the release bar, and wherein at least a portion of the locking projection retains the handgun in the holster in an engaged position, via interaction between at least a portion of the locking projection and an interior surface of a trigger guard of the handgun, and permits release of the handgun when the locking element is in the unlocked position.

In various exemplary, non-limiting embodiments, the locking holster of the presently disclosed systems, methods, and/or apparatuses comprises a side wall portion for receiving at least a portion of a handgun; a locking element with a locking projection extending from a helical ramp surface of the locking element, a central aperture is formed through the locking element with one or more flute guide projections extending into the central aperture; and a release bar having a flute portion with one or more spiral or helical grooves formed therein to interact with at least a portion of the flute guide projections, such that slidable movement of the release bar relative to the locking element produces rotational movement of the locking element, and wherein at least a portion of the locking projection retains the handgun in the holster in an engaged position, via interaction between at least a portion of the locking projection and an interior surface of a trigger guard of the handgun.

In various exemplary, non-limiting embodiments, the locking holster of the presently disclosed systems, methods, and/or apparatuses comprises a holster body defining an at least partial cavity portion for receiving at least a portion of a handgun therein; a locking element having a helical ramp surface, wherein a central aperture is formed through the locking element, wherein one or more flute guide projections extend at least partially into the central aperture, and wherein the locking element is rotatable between a locked position and an unlocked position; and a release bar having one or more spiral or helical grooves defining a flute portion, wherein the flute portion interacts with at least a portion of the flute guide projections such that slidable movement of the release bar relative to the locking element produces rotational movement of the locking element relative to the release bar.

In various exemplary, nonlimiting embodiments, at least a portion of the helical ramp surface extends into the at least partial cavity portion when the locking element in the locked position, and wherein the helical ramp surface is at least partially withdrawn from the at least partial cavity portion when the locking element in the unlocked position.

In various exemplary, nonlimiting embodiments, at least a portion of the helical ramp surface interacts with at least a portion of the handgun when the locking element in the locked position, and wherein the helical ramp surface is withdrawn from the portion of the handgun when the locking element in the unlocked position.

In various exemplary, nonlimiting embodiments, if the locking element is in the locked position, at least a portion of the helical ramp surface of the locking element protrudes into the at least partial cavity portion a sufficient distance to extend inside at least a portion of a trigger guard of the handgun if the handgun is seated within the at least partial cavity portion of the holster.

In various exemplary, nonlimiting embodiments, when the release lever is in a neutral position the flute portion does not interact with the flute guide projections such that the locking element is capable of rotating relative to the release bar.

In various exemplary, non-limiting embodiments, the locking holster of the presently disclosed systems, methods, and/or apparatuses comprises a holster body defining an at least partial cavity portion; a locking element having a helical ramp surface, wherein the helical ramp surface extends to a locking projection, wherein at least a portion of the locking projection extends from at least a portion of the locking element, wherein a central aperture is formed through the locking element, wherein one or more flute guide projections extend at least partially into the central aperture, and wherein the locking element is rotatable between a locked position and an unlocked position; and a release bar having one or more spiral or helical grooves defining a flute portion, wherein when the flute portion interacts with at least a portion of the flute guide projections, slidable movement of the release bar relative to the locking element produces rotational movement of the locking element relative to the release bar.

In various exemplary, non-limiting embodiments, the locking holster of the presently disclosed systems, methods, and/or apparatuses comprises a locking element having a helical ramp surface, wherein a central aperture is formed through the locking element, wherein one or more flute guide projections extend at least partially into the central aperture, and wherein the locking element is rotatable between a locked position and an unlocked position; and a release bar having a flute portion, wherein when the flute portion interacts with at least a portion of the flute guide projections, slidable movement of the release bar relative to the locking element produces rotational movement of the locking element relative to the release bar.

Accordingly, the locking holster of the present disclosure separately and optionally provides a quick-release handgun holster.

The locking holster of the present disclosure separately and optionally provides a handgun holster, which is capable of retaining a handgun securely in the holster while permitting a quick release of the handgun when the user requires.

The locking holster of the present disclosure separately and optionally provides a handgun holster, which is simple to operate.

The locking holster of the present disclosure separately and optionally provides a handgun holster, which automatically secures the handgun in the holster upon seating of the handgun in the holster, without requiring any additional operation by the user.

The presently disclosed systems, methods, and/or apparatuses separately and optionally provide a locking holster that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
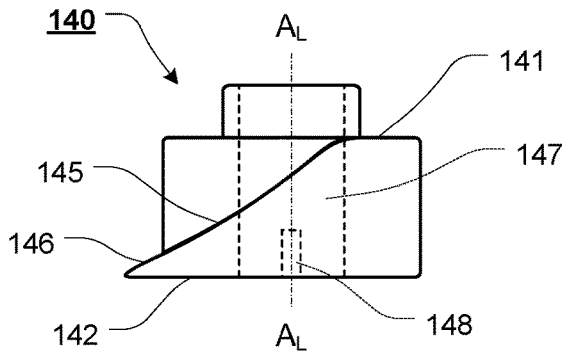
FIG. 1 illustrates a side view of an exemplary embodiment of a locking element, according to the presently disclosed systems, methods, and/or apparatuses.
Figure 2:
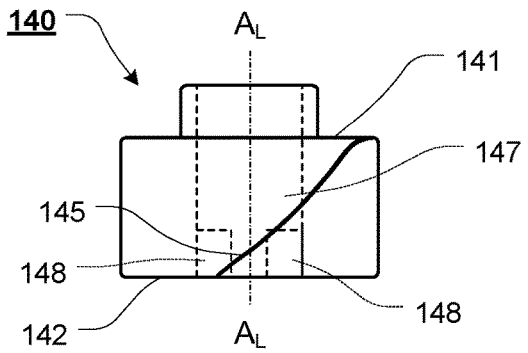
FIG. 2 illustrates a side view of an exemplary embodiment of a locking element, according to the presently disclosed systems, methods, and/or apparatuses.
Figure 3:
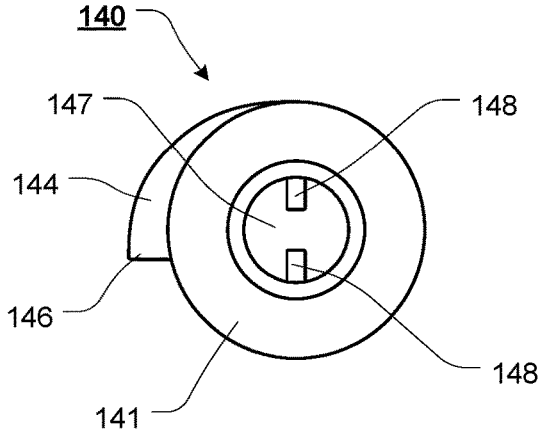
FIG. 3 illustrates a top view of an exemplary embodiment of a locking element, according to the presently disclosed systems, methods, and/or apparatuses.
Figure 4:
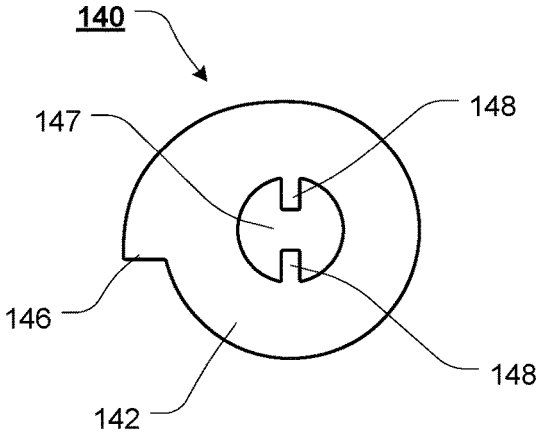
FIG. 4 illustrates a bottom view of an exemplary embodiment of a locking element, according to the presently disclosed systems, methods, and/or apparatuses.
Figure 5:
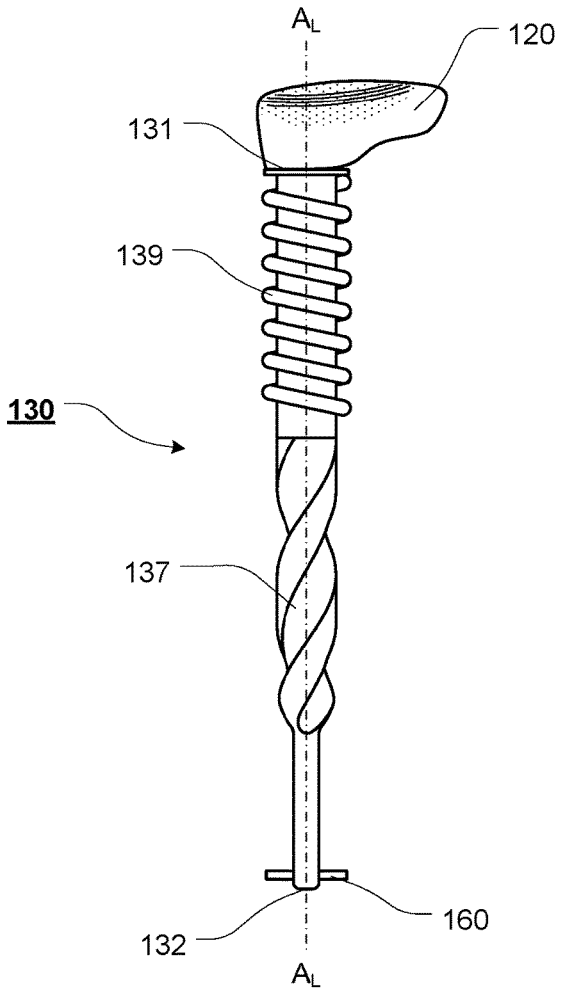
FIG. 5 illustrates a side view of an exemplary embodiment of an engagement lever and release bar, according to the presently disclosed systems, methods, and/or apparatuses.
Figure 6:
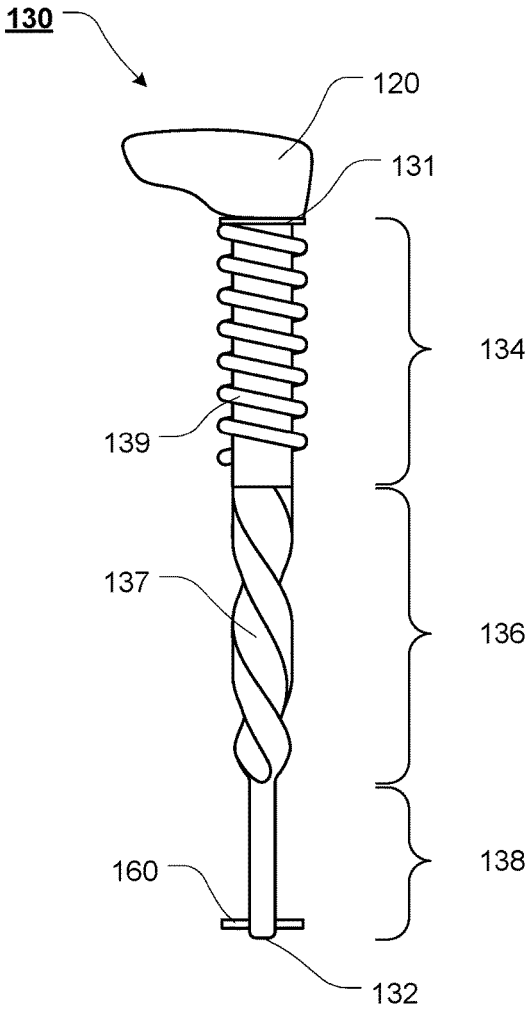
FIG. 6 illustrates a side view of an exemplary embodiment of an engagement lever and release bar, according to the presently disclosed systems, methods, and/or apparatuses.
Figure 7:
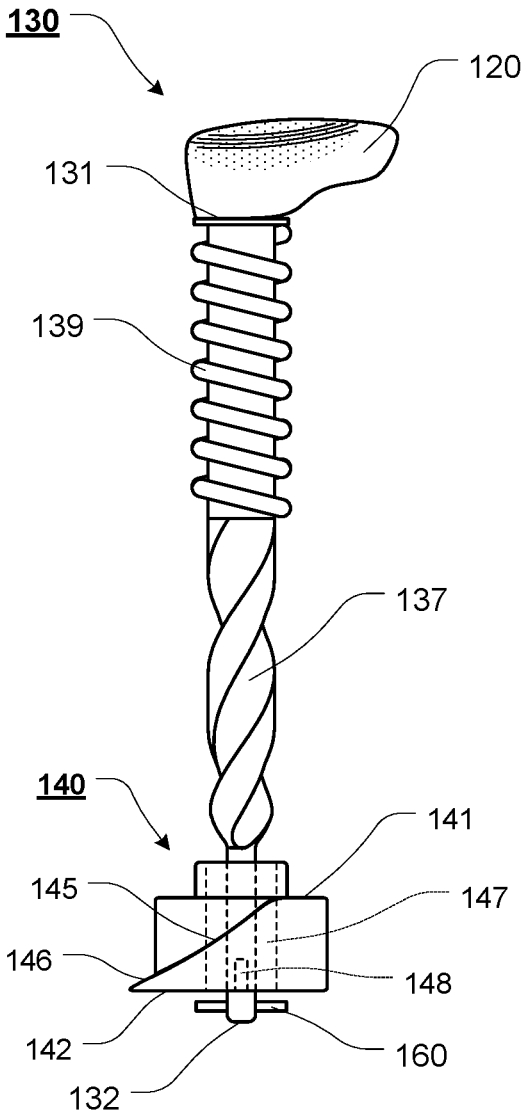
FIG. 7 illustrates a side view of an exemplary embodiment of an engagement lever and release bar, wherein an exemplary locking element is in a locked position relative to the release bar, according to the presently disclosed systems, methods, and/or apparatuses.
Figure 8:
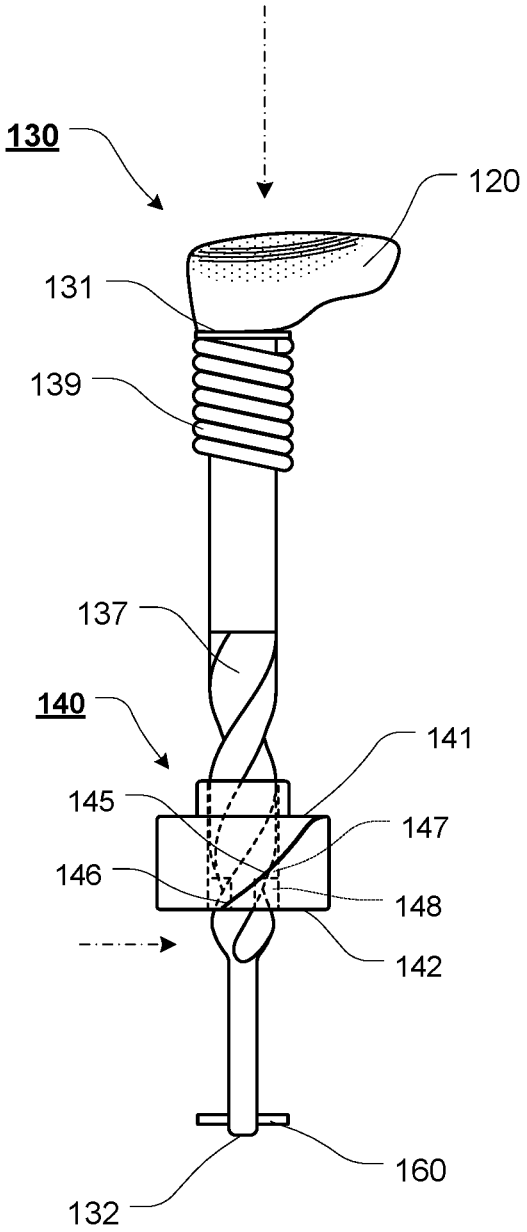
FIG. 8 illustrates a side view of an exemplary embodiment of an engagement lever and release bar, wherein an exemplary locking element is in an unlocked position relative to the release bar, according to the presently disclosed systems, methods, and/or apparatuses.
Figure 9:
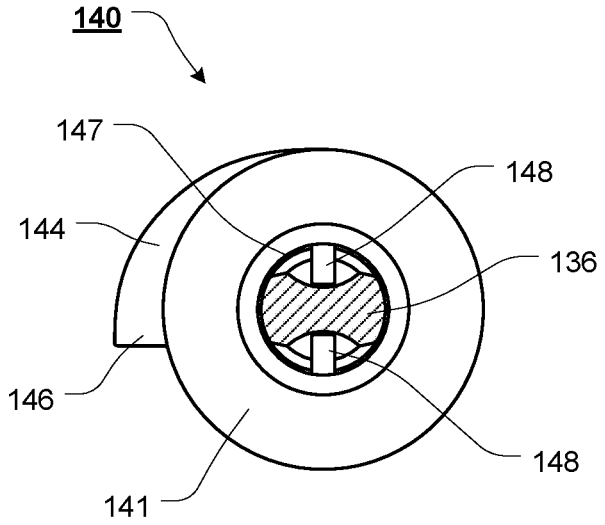
FIG. 9 illustrates a top view of an exemplary embodiment of a locking element in a cross-sectional view of the release bar interacting with the locking element, according to the presently disclosed systems, methods, and/or apparatuses.
Figure 10:
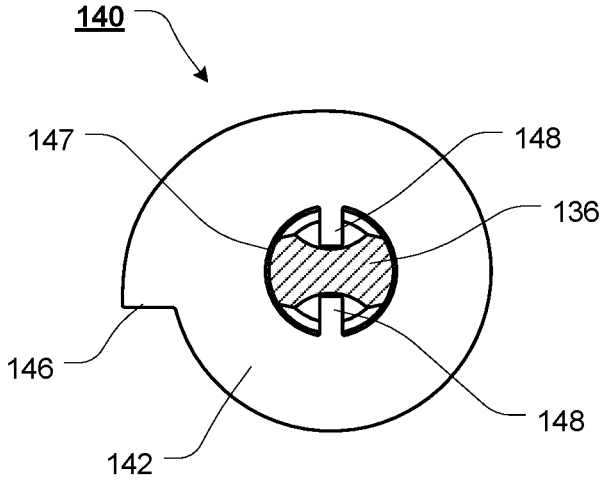
FIG. 10 illustrates a bottom view of an exemplary embodiment of a locking element in a cross-sectional view of the release bar interacting with the locking element, according to the presently disclosed systems, methods, and/or apparatuses.
Figure 11:
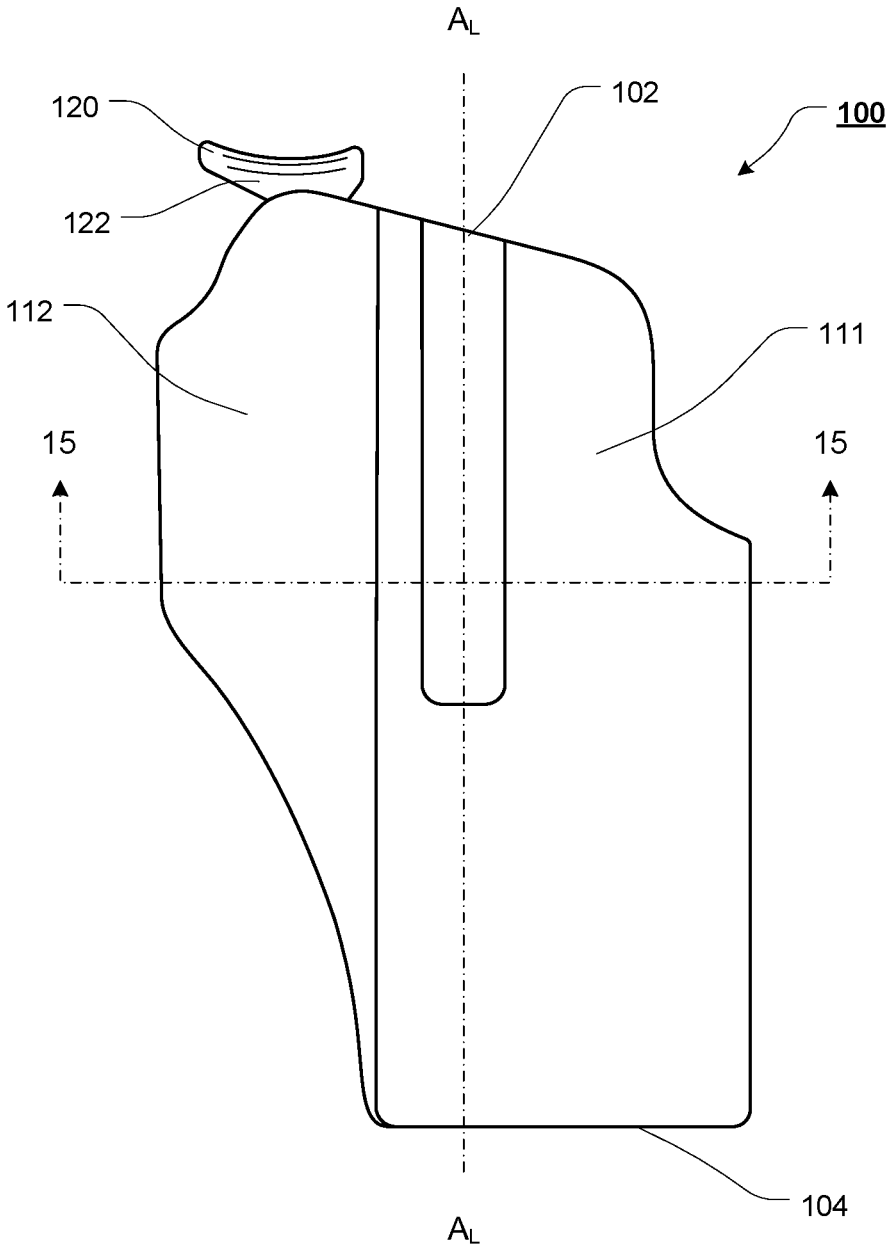
FIG. 11 illustrates a right side view of an exemplary embodiment of a locking holster, according to the presently disclosed systems, methods, and/or apparatuses.

For simplicity and clarification, the design factors and operating principles of the locking holster according to the presently disclosed systems, methods, and/or apparatuses are explained with reference to various exemplary embodiments of a locking holster according to the presently disclosed systems, methods, and/or apparatuses. The basic explanation of the design factors and operating principles of the locking holster is applicable for the understanding, design, and operation of the locking holster of the presently disclosed systems, methods, and/or apparatuses. It should be appreciated that the locking holster can be adapted to many applications where a locking holster can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains"

one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handgun", "holster", and "locking holster" are used for a basic explanation and understanding of the operation of the systems, methods, and apparatuses of the present disclosure. Therefore, the terms "handgun", "holster", and "locking holster" are not to be construed as limiting the systems, methods, and apparatuses of the present disclosure.

Furthermore, it should be appreciated that, for simplicity and clarification, the embodiments of the present disclosure will be described with reference to a semiautomatic-type handgun being secured within the holster of the present disclosure. However, it should be appreciated that the operating principles of the disclosed holster may also be employed to construct holsters or holders for any revolver or semiautomatic-type handgun, edged weapons as well as less than lethal products (i.e., tasers, pepper spray, mace canisters, or batons), so long as these items have an appropriate ledge (such as, for example, a portion of an ejection port) or void that may be engaged or retained by a locking projection or other retaining means. Furthermore, it is also within the scope of the present disclosure that the present holster may be employed as a pouch for tactical accessories, such as ammunition magazines and/or flashlights, as well as for other items having a shelf for surface.

Turning now to the appended drawing figures, FIGS. 1-20 illustrate certain elements and/or aspects of an exemplary locking handgun holster 100, according to the present disclosure. It should be appreciated that the exemplary holster 100 is adapted to retain an exemplary semiautomatic-type handgun 180. The semiautomatic-type handgun 180 generally includes a slide portion 183 and a frame portion 185. The frame portion 185 generally includes a dust cover, a grip, a trigger guard 186, and a trigger. The trigger guard 186 includes an inner surface 188, which defines an area wherein the trigger is located and allows a user's finger access to the trigger, and an outer surface 187, which defines the outer perimeter of the trigger guard 186.

In illustrative, non-limiting embodiment(s) of the presently disclosed systems, methods, and/or apparatuses, as illustrated in FIGS. 11-20, the exemplary holster 100 includes a holster body 103 defining an at least partial cavity portion 105 for receiving and holding the handgun 180. The holster body 103 comprises at least a first wall portion 106 and optionally a second wall portion 107, opposing the first wall portion 106, and a pair of opposed wall portions comprising a third wall portion 108 and a fourth wall portion 109. Typically, the first wall portion 106 is considered the inner side of the holster 100 and is worn against or adjacent the user's body, while the second wall portion 107, the third wall portion 108, and/or the fourth wall portion 109 form additional side wall portions of the holster 100 and may be included to assist in maintaining at least portions of the handgun 180 against at least a portion of the first wall portion 106, within at least the at least partial cavity portion 105, and/or within at least a portion of the holster body 103.

However, it should be appreciated that the holster 100 may be formed such that one or more of the first wall portion 106, the second wall portion 107, the third wall portion 108, and/or the fourth wall portion 109 is/are sufficient to define the at least partial cavity portion 105 for receiving the handgun 180 and the remaining wall portions are not included.

The at least partial cavity portion 105 includes a holster body top portion 102 and a holster body bottom portion 104 and may be formed from any number or combination of wall portions, including, for example, a single, continuous wall portion or multiple coupled or joined wall portions.

In certain exemplary, nonlimiting embodiments, the holster body 103 merely comprises a single wall portion, such as, for example, the first wall portion 106. Any remaining portions of the holster 100 may be attached, coupled, or formed as a portion or extension of the holster body 103.

Thus, the at least partial cavity portion 105 may be formed by any cavity, partial cavity, space, wall portion, or platform that is capable of retaining at least a portion of a handgun 180, either alone or with an additional strap or other element(s).

In certain exemplary, nonlimiting embodiments, as illustrated, the holster body 103 and/or the at least partial cavity portion 105 includes a holster trigger guard portion 112 and optionally a holster slide portion 111. At least a portion of the holster trigger guard portion 112 is shaped so as to receive and accommodate at least a portion of the trigger guard 186 of an inserted or adjacent handgun 180. In various exemplary embodiments, the holster trigger guard portion 112 is generally formed by a portion of the first wall portion 106 or the holster body 103 of the holster 100. The holster trigger guard portion 112 is shaped generally to match the contours of at least a portion of the outer surface 187 of the trigger guard 186. The holster trigger guard portion 112 is formed so as to contact at least a portion of the outer surface 187 of the trigger guard 186 of the inserted handgun 180 and further limit how far the handgun 180 can be inserted into the holster 100.

The construction of the holster 100 further facilitates alignment of the trigger guard 186 with the locking projection 146 by limiting lateral movement of the handgun 180 with respect to the locking projection 146 without preventing a user from easily holstering or unholstering the handgun 180.

It should be noted that the wall portions of the holster 100 may generally be planar. Alternatively, the wall portions of the holster 100 may be contoured or shaped to better accommodate a specific type or model of handgun 180 to be retained within the holster 100.

In various exemplary embodiments, the holster 100 optionally includes at least one holster body attachment portion 114, which provides an area or device for fastening the holster 100 to a holster 100 holding device. Alternatively, the means for holster body attachment portion 114 may comprise a clip or hook adapted to, for example, be clipped over or to a belt. In further exemplary embodiments, the holster body attachment portion 114 may comprise one or more quick-disconnect or other couplings, which may be permanently or removably coupled to corresponding and cooperating coupling(s) provided on a belt or other carrier or platform. In still other exemplary embodiments, the holster 100 may comprise an integral belt, or may comprise one or more connections for attachment to a chest, ankle, leg, shoulder, or other harness or band, or for otherwise securing the holster 100 to a user or the user's apparel.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

Thus, it should be understood that the material or materials used to form the holster 100 and/or various components of the holster 100 is a design choice based on the desired appearance and functionality of the holster 100.

As further shown in FIGS. 1-4 and 7-20, the holster 100 comprises a locking element 140 that is capable of operating to retain a handgun 180 securely in the holster 100 by restricting withdrawal of the handgun 180 from the at least partial cavity portion 105 of the holster 100, when in a locked position, while permitting a quick release of the handgun 180, when in an unlocked position.

FIGS. 1-20 illustrate certain elements and/or aspects of an exemplary embodiment of a release bar 130 and a locking element 140 usable as components of a locking handgun holster 100 according to the present disclosure. It should be appreciated that the release bar 130 and locking element 140 are usable with an exemplary holster 100.

As illustrated most clearly in FIGS. 1-4, in various exemplary, nonlimiting embodiments, the locking element 140 comprises a substantially cylindrical portion of material extending from a proximal end 141 to a distal end 142 and having a single or double helical portion 145 formed in or around at least a portion of the locking element 140. In certain alternative embodiments, the locking element 140 may have an overall cylindrical or conical shape. Thus, the locking element 140 may have a substantially consistent diameter, an increasing diameter, or a decreasing diameter from the proximal end 141 to the distal end 142.

In various exemplary embodiments, the locking element 140 includes a single or double helix or helical protrusion that extends from at least a portion of the surface of the locking element 140. Alternatively, the locking element 140 includes a single or double helix or helical recess formed in at least a portion of the surface of the locking element 140. Whether a protrusion or recess, the helical portion 145 provides a helical ramp surface 144 or rim that curves around at least a portion of the locking element 140. In certain exemplary embodiments, the helical portion 145 or helical ramp surface 144 generally follows a spiral or a curve along a portion of the locking element 140 that can be defined by the rotation of a point crossing cross-sections (taken perpendicular to the longitudinal axis of the locking element 140) of the helical portion 145, at a consistent oblique angle.

The locking element 140 includes a central aperture 147 formed through the locking element 140, substantially along the longitudinal axis, $A_L$, of the locking element 140. In various exemplary embodiments, one or more flute guide projections 148 extend at least partially into the central aperture 147 of the locking element 140.

The release bar 130 extends from a first end 131 to an initial portion 134, a flute portion 136, an extension portion 138, and a second end 132. A locking element securing element 160 may optionally be included proximate the second end 132 of the release bar 130 to assist in keeping the second end 132 of release bar 130 from being withdrawn from the central aperture 147 of the locking element 140.

A release lever 120 is optionally attached or coupled at the first end 131 or proximate the first end 131 of the release bar 130. In certain exemplary embodiments, the release lever 120 is attached or coupled to a terminal portion of the first end 131 of the release bar 130. The release lever 120 includes a top side facing generally upward from the holster 100.

In various exemplary embodiments, a portion of the release lever 120 includes a textured portion 125. In this manner, a portion of the release lever 120 may be distinguished tactilely from other portions of the release lever 120 or the holster 100.

A release bar channel 116 is formed in or through at least a portion of the first wall portion 106. In various exemplary embodiments, the release bar channel 116 is formed through the material forming the holster body 103. Alternatively, the release bar channel 116 is formed so as to include an at least partial release bar channel 116 insulator or other sheathing material. The release bar channel 116 is formed so as to have an inner diameter that allows at least a portion of a release bar 130 to be slidably fitted within the release bar channel 116 and substantially freely travel along and within the release bar channel 116. Generally, the release bar channel 116 is formed proximate the holster trigger guard portion 112.

In various exemplary embodiments, the release bar channel 116 is positioned substantially parallel to a vertical axis of the holster 100, substantially perpendicular to a vertical axis of the holster 100, at a substantially acute angle relative to a vertical axis of the holster 100, or at a substantially obtuse angle relative to a vertical axis of the holster 100. Thus, the release bar channel 116 may be positioned at any angle relative to a vertical axis of the holster 100.

The locking element 140 is rotatably positioned within at least a portion of the first wall portion 106 of the holster body 103, such that the locking element 140 substantially maintains its position relative to the longitudinal axis of the first wall portion 106 of the holster body 103. The locking element 140 is rotatably attached or coupled to the release bar 130. In various exemplary embodiments, the locking element 140 is biased to a locked position by, for example, a biasing element. In this manner, in a static condition, wherein the release bar 130 is in the neutral position, the locking element 140 is biased to a locked position.

The locking element 140 is rotatable within at least a portion of the holster trigger guard portion 112. In certain exemplary, nonlimiting embodiments, the locking element 140 is positioned at least partially within a holster recess 118 formed so as to allow the locking element 140 to rotate freely without contact or interaction from external objects or forces on a side opposite the holster recess 118.

Figure 12:
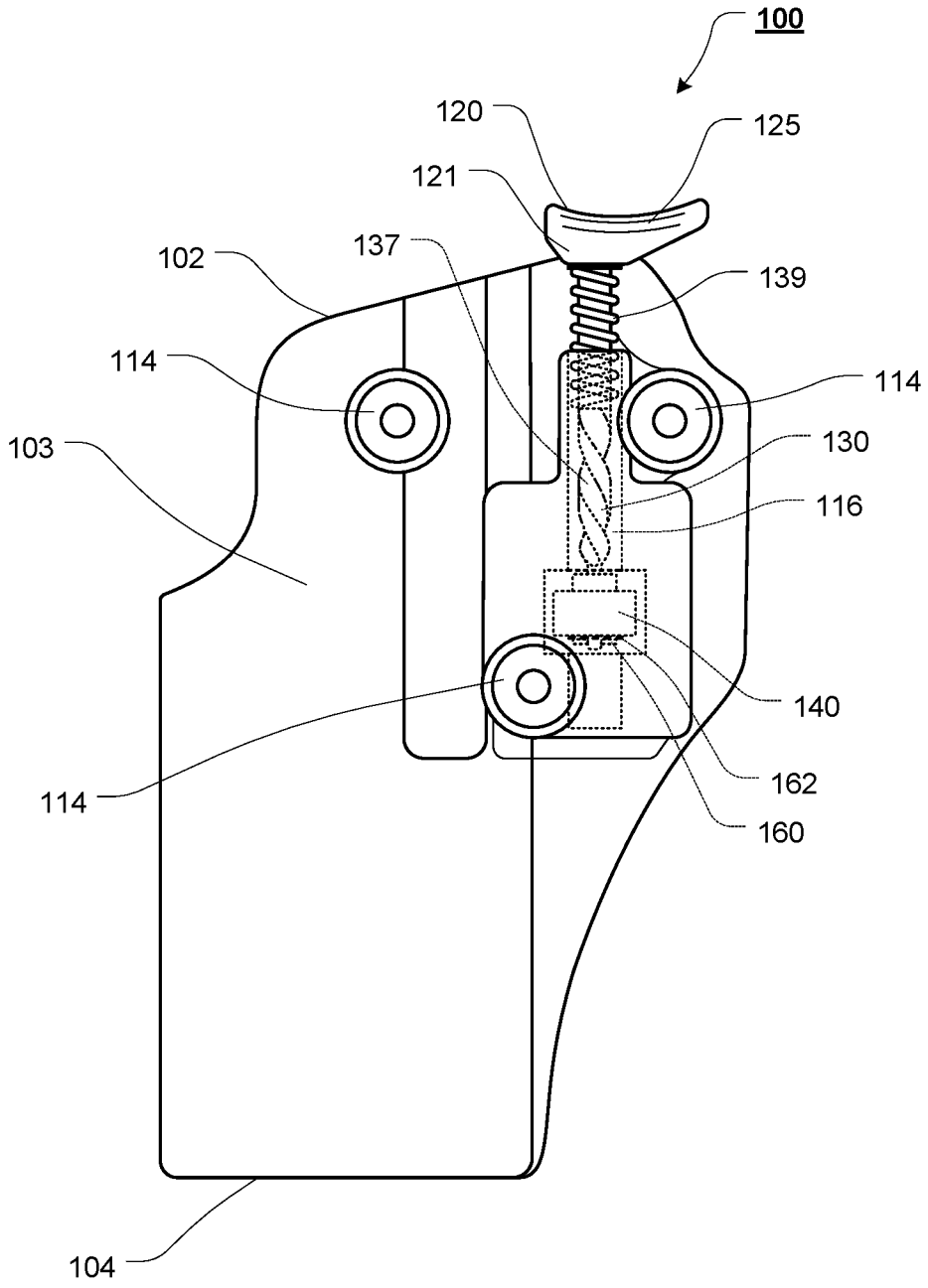
FIG. 12 illustrates a left side view of an exemplary embodiment of a locking holster, illustrating the release bar in a neutral position, according to the presently disclosed systems, methods, and/or apparatuses.
Figure 13:
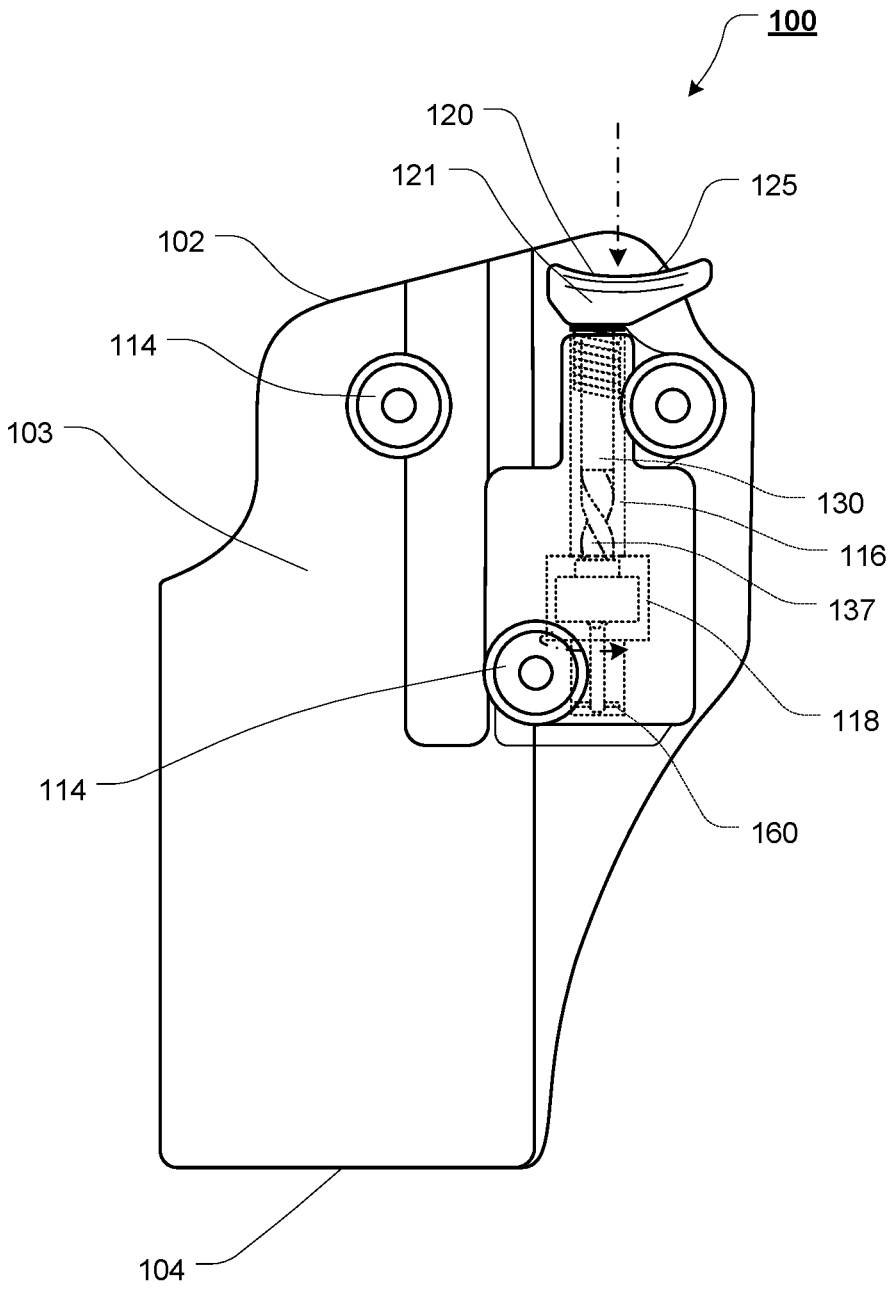
FIG. 13 illustrates a left side view of an exemplary embodiment of a locking holster, illustrating the release bar in an engaged position, according to the presently disclosed systems, methods, and/or apparatuses.
Figure 14:
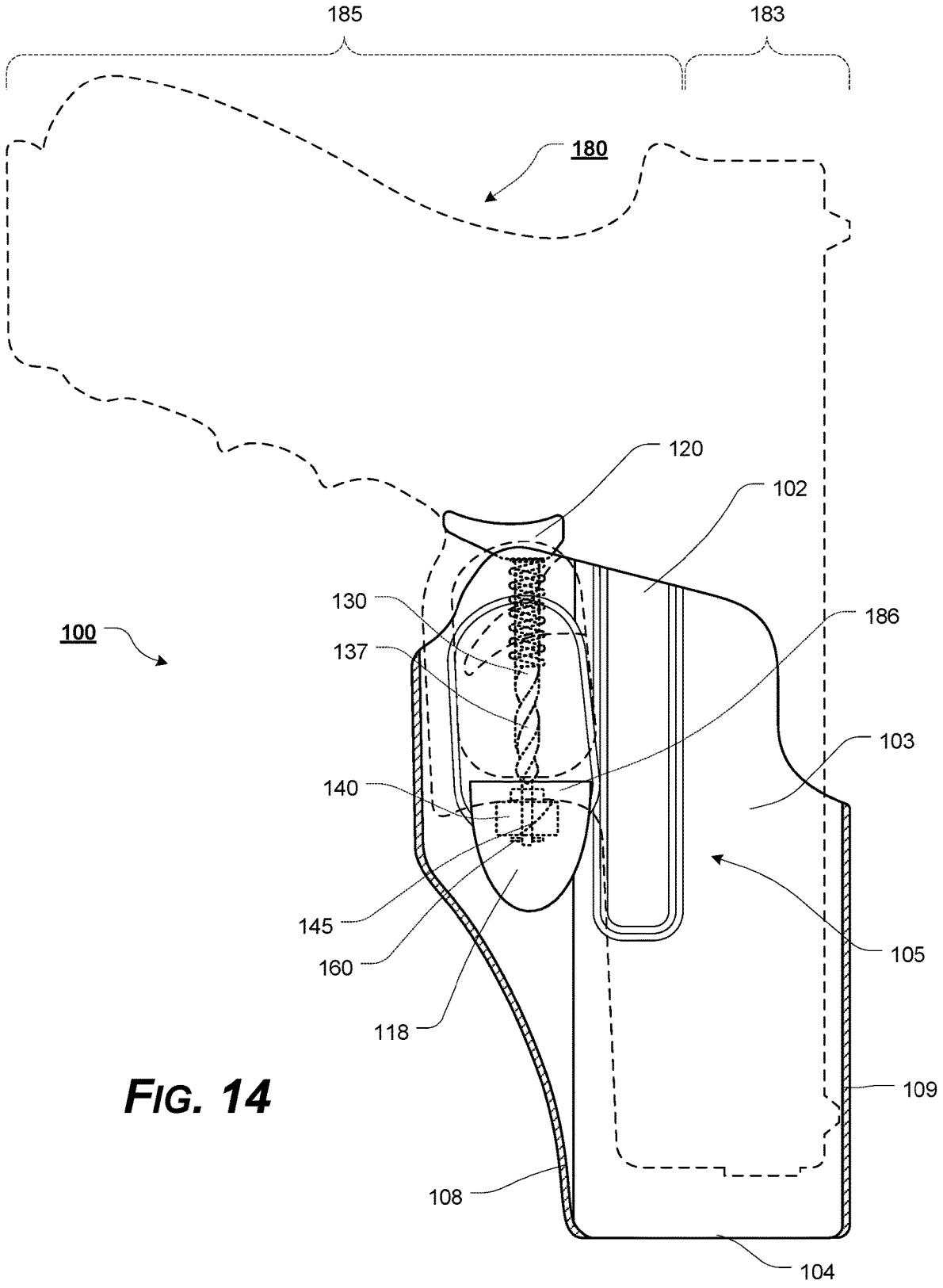
FIG. 14 illustrates a right side, cross-sectional view of an exemplary embodiment of a holster, wherein an exemplary handgun is partially inserted within the holster, according to the presently disclosed systems, methods, and/or apparatuses.
Figure 15:
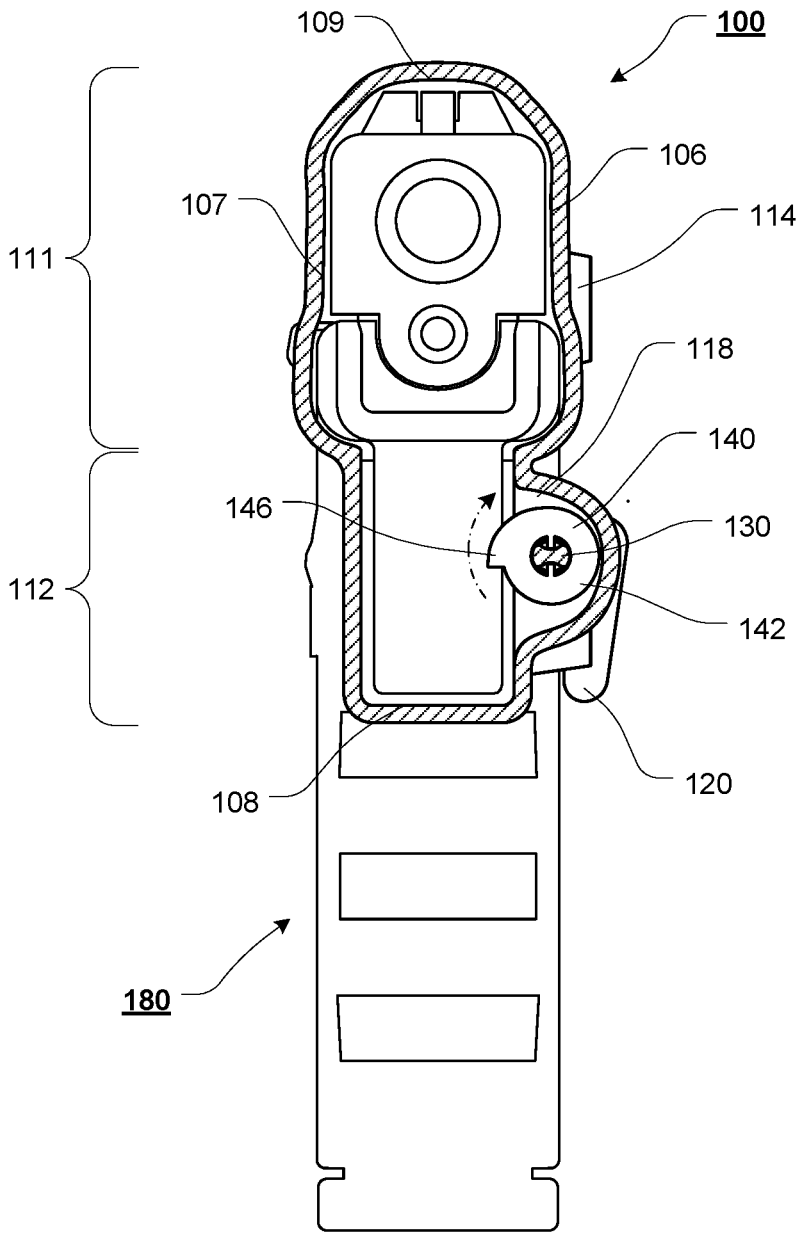
FIG. 15 illustrates a bottom, cross-sectional view, taken along line 15-15 of FIG. 11, of an exemplary embodiment of a holster, wherein an exemplary handgun is partially inserted within the holster, according to the presently disclosed systems, methods, and/or apparatuses.
Figure 16:
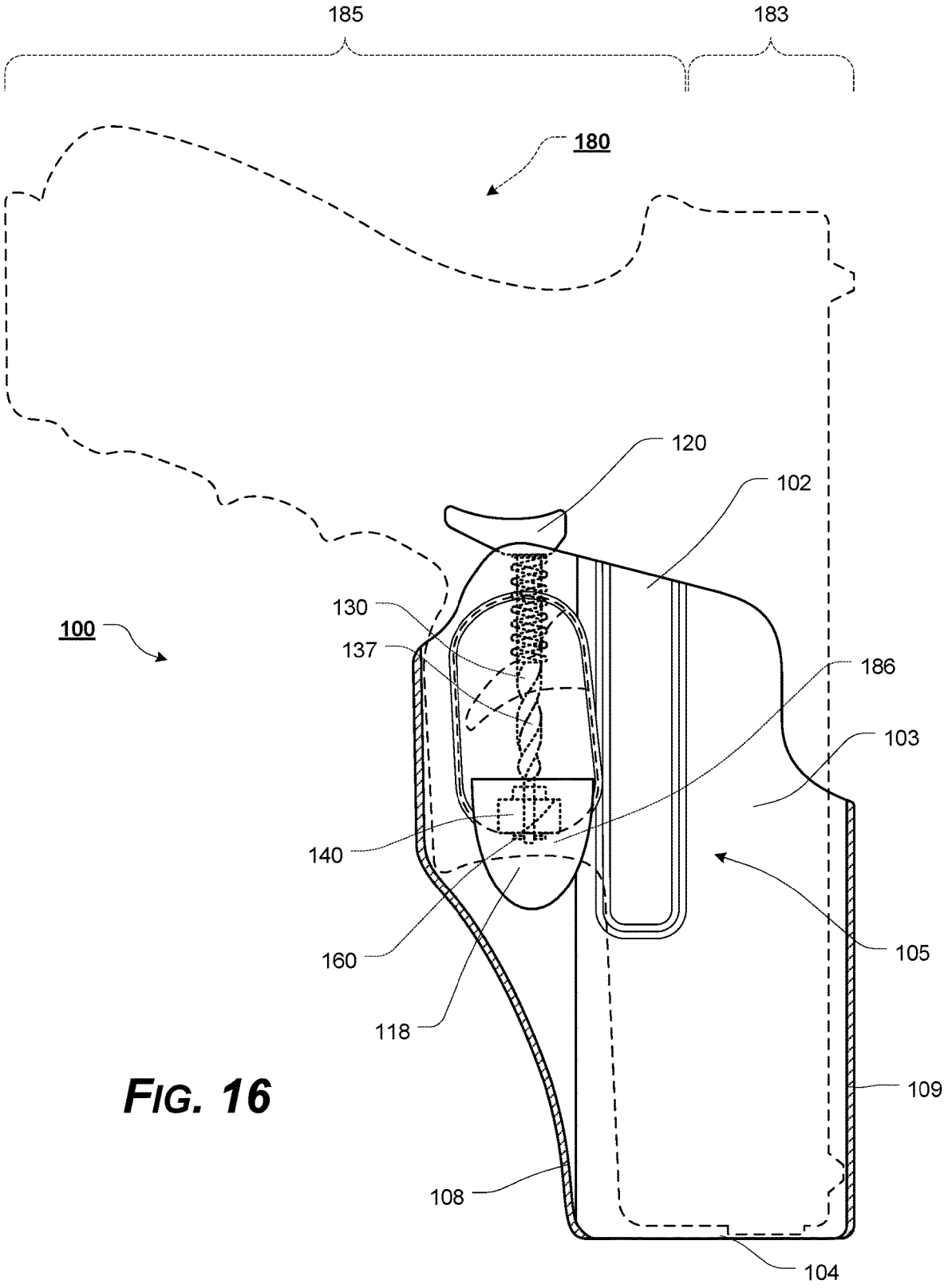
FIG. 16 illustrates a right side, cross-sectional view of an exemplary embodiment of a holster, wherein an exemplary handgun is inserted within the holster, in a secured position, according to the presently disclosed systems, methods, and/or apparatuses.
Figure 17:
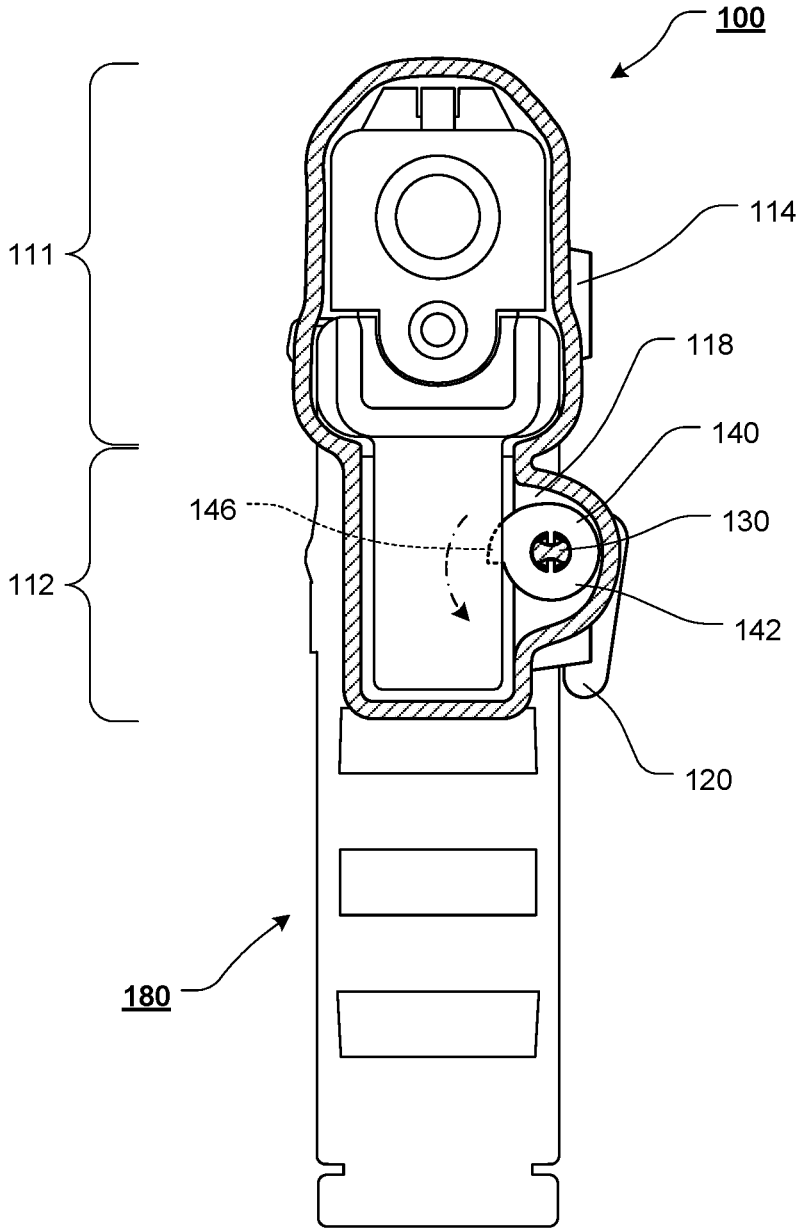
FIG. 17 illustrates a bottom, cross-sectional view, taken along line 15-15 of FIG. 11, of an exemplary embodiment of a holster, wherein an exemplary handgun is inserted within the holster, wherein the release bar is in an engaged position, according to the presently disclosed systems, methods, and/or apparatuses.
Figure 18:
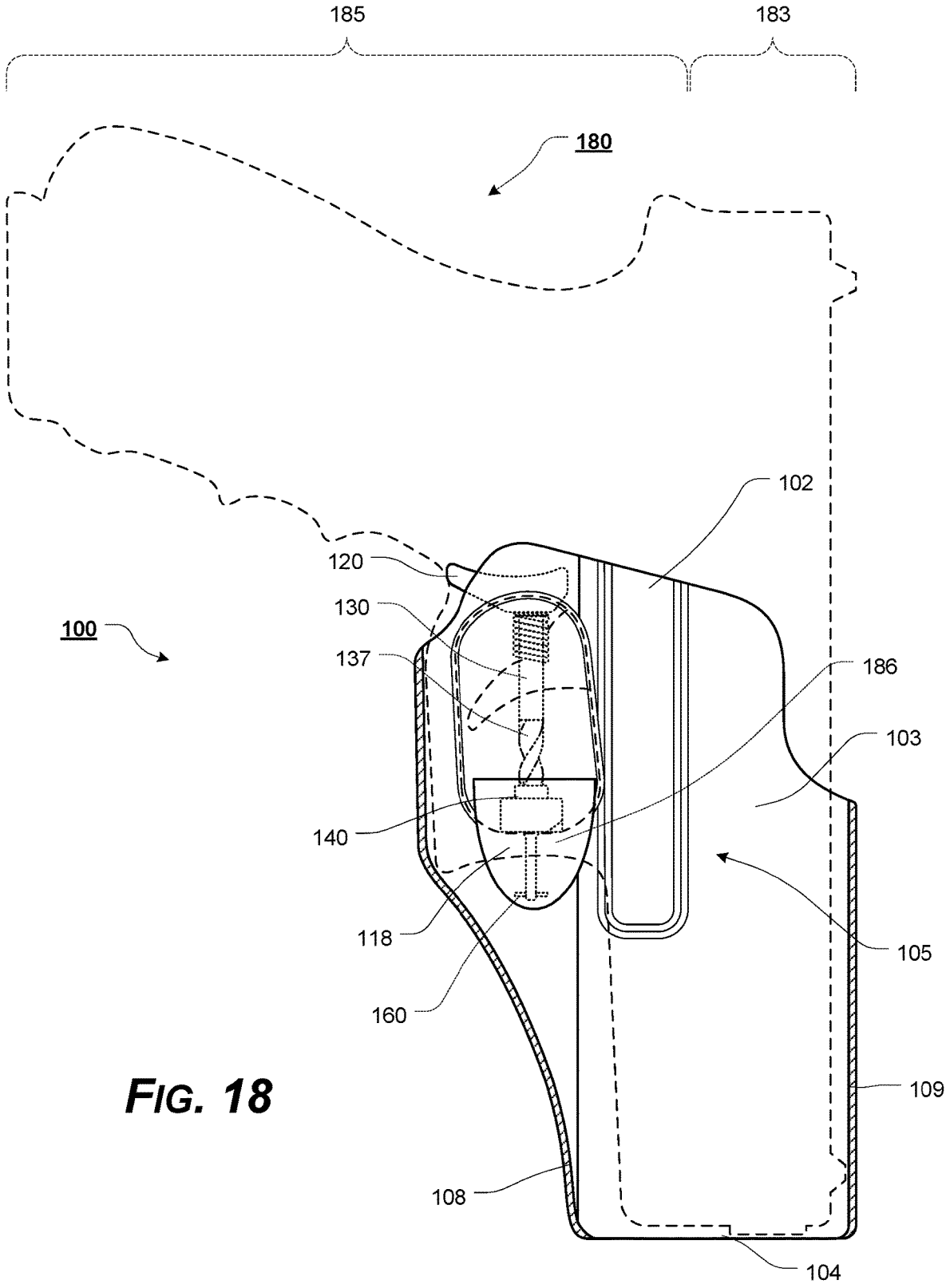
FIG. 18 illustrates a right side, cross-sectional view of an exemplary embodiment of a holster, wherein an exemplary handgun is inserted within the holster, wherein the release bar is in an engaged position, according to the presently disclosed systems, methods, and/or apparatuses.
Figure 19:
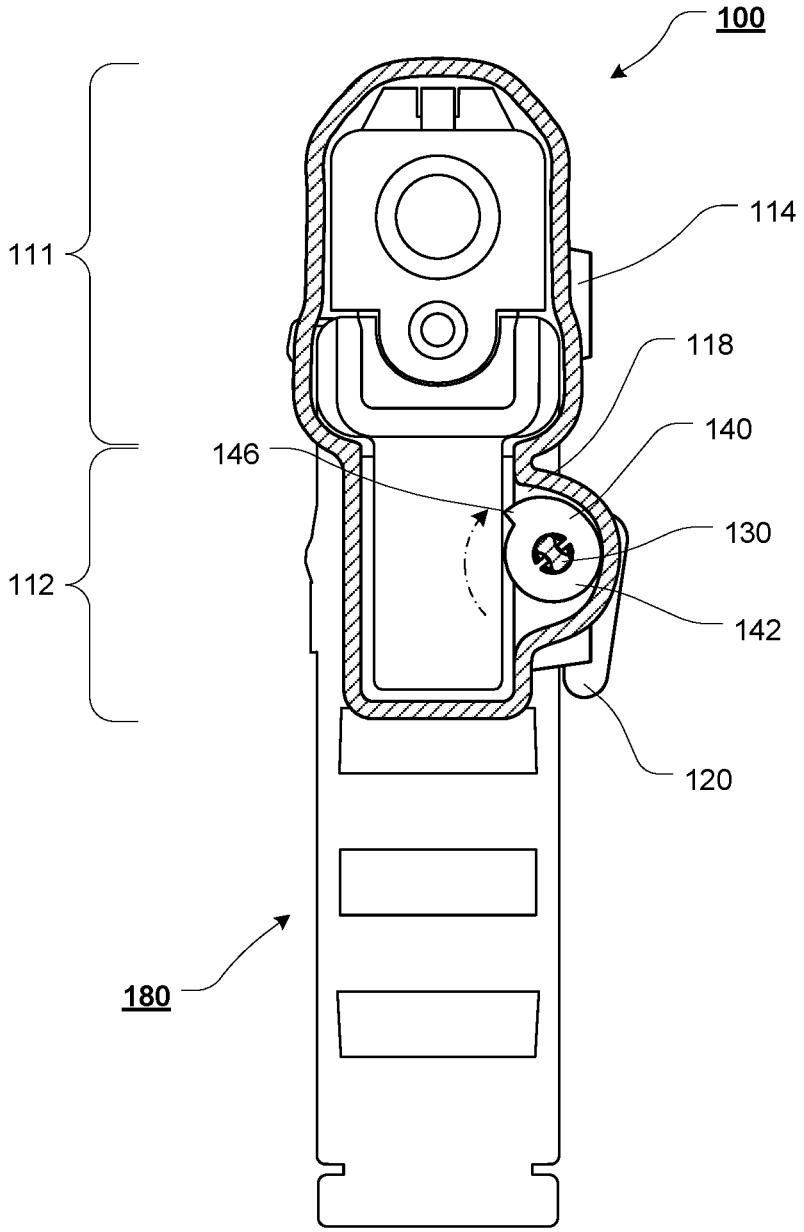
FIG. 19 illustrates a bottom, cross-sectional view, taken along line 15-15 of FIG. 11, of an exemplary embodiment of a holster, wherein an exemplary handgun is inserted within the holster, wherein the release bar is in an engaged position, according to the presently disclosed systems, methods, and/or apparatuses.
Figure 20:
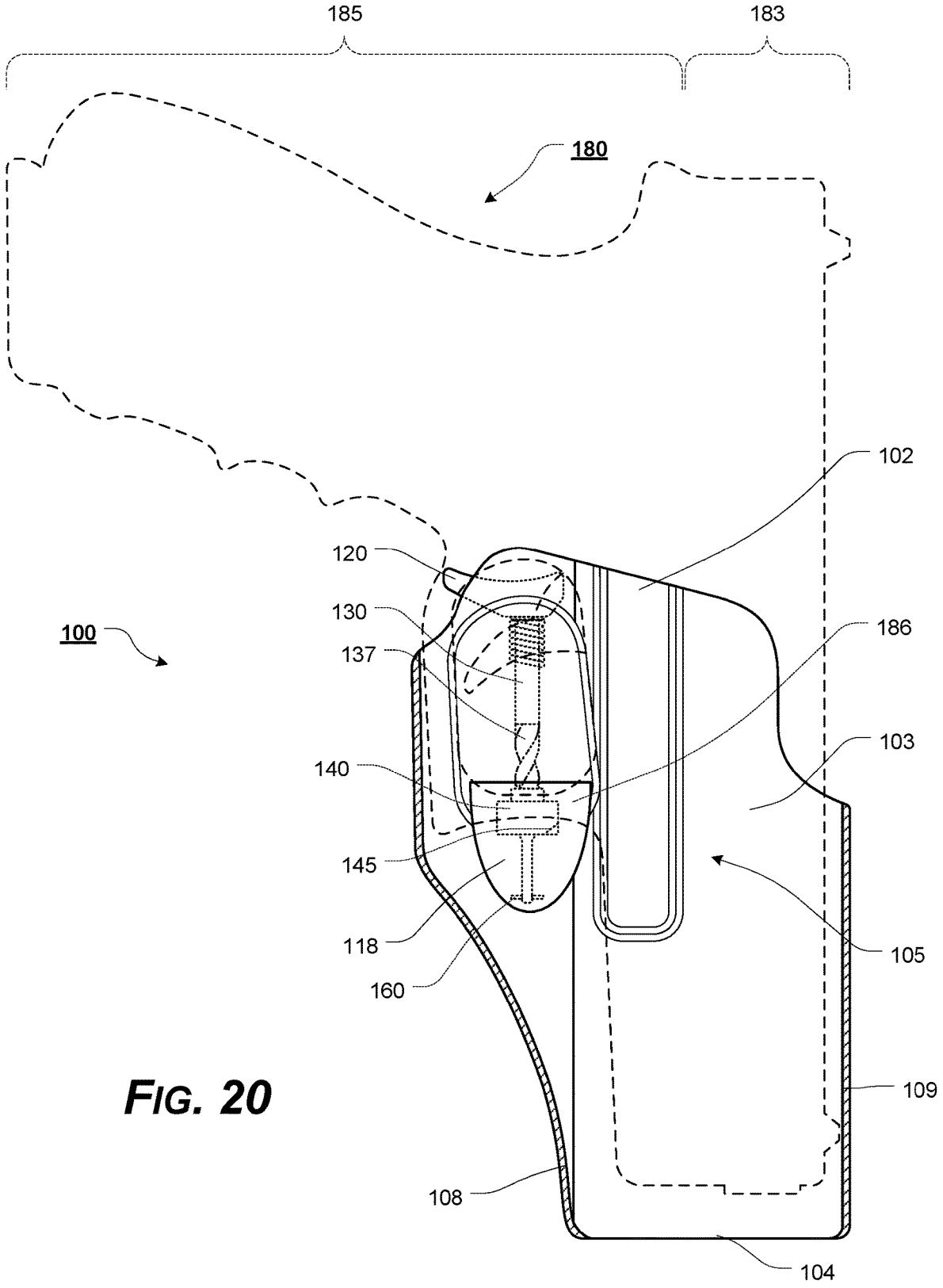
FIG. 20 illustrates a right side, cross-sectional view of an exemplary embodiment of a holster, wherein an exemplary handgun is partially withdrawn within the holster, wherein the release bar is in an engaged position, according to the presently disclosed systems, methods, and/or apparatuses.

The release bar 130 is repeatably slidable between a neutral position, as illustrated, for example, in FIGS. 12, 16, 17 and an engaged position, as illustrated, for example, in FIGS. 13, 18, and 19. Thus, when the release bar 130 is slidably positioned within the release bar channel 116, slidable manipulation of at least a portion of the release lever 120 (either toward or away from the locking element 140 along the first wall portion 106 of the holster body 103), results in movement of the locking element 140 relative to the release bar 130.

In various exemplary embodiments, the release bar 130 (and thus the locking element 140) may optionally be biased to the neutral position, whether a handgun 180 is present in the holster 100 or absent from the holster 100. In various exemplary embodiments, biasing of the release bar 130 may be accomplished by, for example, a release bar biasing element 139 secured between at least a portion of the holster body 103 and the release lever 120. The locking element 140 biasing element may comprise a coil or other spring or any suitable spring mechanism or resilient element. In various exemplary embodiments, the release bar biasing element 139 is positioned around at least a portion of the initial portion 134.

One or more spiral or helical flutes 137 are formed in the flute portion 136. Each spiral or helical flutes 137 comprises a groove formed in the flute portion 136.

It should be appreciated that the pitch and depth of the spiral or helical flutes 137 is a design choice based upon the desired rotational movement of the locking element 140 resulting from movement of the release bar 130 along its longitudinal axis.

The flute guide projections 148 are formed so as to extend at least partially into the central aperture 147 and interact with the spiral or helical flutes 137 of the flute portion 136 to rotate the locking element 140 relative to the release bar 130. In various exemplary embodiments, the extension portion 138 substantially cylindrical so as to allow the locking element 140 to free rotate relative to the extension portion 138.

The spiral or helical flutes 137 are formed so as to receive at least a portion of the flute guide projections 148 therein, such that as the flute guide projections 148 interact with the spiral or helical flutes 137, movement of the release bar 130 along the longitudinal axis of the release bar 130 results in rotational movement of the locking element 140 along the longitudinal axis of the locking element 140.

As the release bar 130 is urged toward the locking element 140, against the biasing force of the release bar biasing element 139, the locking element 140 moves from the extension portion 138 to the flute portion 136. As the release bar 130 continues to be urged toward the locking element 140 (toward the unlocked position) the spiral or helical flutes 137 interact with the flute guide projections 148 and the locking element 140 is rotated from the locked position to the unlocked position.

As the release bar 130 is moved away from the locking element 140 (toward the neutral position), the spiral or helical flutes 137 interact with the flute guide projections 148 and the locking element 140 is rotated from the unlocked position toward the locked position.

When the release bar 130 is slidably retracted a sufficient distance, such that the locking element 140 engages the extension portion 138 of the release bar 130, the locking element 140 is maintained in the locked position. In various exemplary embodiments, the locking element 140 is maintained in the locked position via interaction of the flute guide projections 148 and spiral or helical flutes 137 formed in the extension portion 138.

When the locking element 140 is in the locked position, at least a portion of the locking projection 146 of the locking element 140 extends a sufficient distance into the trigger guard 186 portion so as to protrude within at least a portion of the trigger guard 186 and potentially contact at least a portion of an inner surface 188 of the trigger guard 186. When the locking element 140 is in the unlocked position, the locking projection 146 is rotated so as to allow at least an inner surface 188 of the trigger guard 186 to pass by the locking projection 146.

Regardless of the particular handgun 180 to be used in conjunction with the holster 100, the locking projection 146 is shaped so that there is no possibility that the locking projection 146 can at any time contact the trigger of the handgun 180. When the handgun 180 is pushed as far forward as possible into the holster 100, a space is maintained between the locking projection 146 and the trigger of the handgun 180.

When the release bar 130 is in the neutral position, the locking projection 146 protrudes so as to extend inside the at least partial cavity portion 105 and inside the trigger guard 186 of a handgun 180 that is placed into the holster 100 and, thereby, retain the handgun 180 in the holster 100.

In various exemplary embodiments, the locking projection 146 protrudes into the at least partial cavity portion 105 for a distance that is less than the width of the trigger guard 186. Alternatively, the locking projection 146 may protrude into the at least partial cavity portion 105 for a distance that is equal to or greater than the width of the trigger guard 186.

In various exemplary embodiments, the locking element 140 is independently biased to the locked position and when the locking element 140 is positioned along the extension portion 138, the locking element 140 is able to freely rotate relative to the release bar 130. Thus, when the locking element 140 is positioned within the extension portion 138, the spring biasing force acting on the locking element 140 rotates the locking element 140 to the locked position.

In this manner, as a handgun 180 is inserted into the at least partial cavity portion 105 of the holster 100, muzzle first, the handgun 180 is guided into position by at least some portion of the holster 100, such as, for example, the first wall portion 106, the second wall portion 107, the third wall portion 108, and/or the fourth wall portion 109.

As the handgun 180 is inserted further into the at least partial cavity portion 105, at least a portion of the trigger guard 186 will slide adjacent or against the holster trigger guard portion 112 and a portion of the outer surface 187 of the trigger guard 186 will contact the helical portion 145 and/or the helical ramp surface 144 of the locking element 140. The shape of the helical portion 145 and/or the helical ramp surface 144 allows at least a portion of the helical portion 145 to ride along the surface of the trigger guard 186 and apply a rotational force to rotate the locking element 140 toward the unlocked position. As the helical portion 145 continues to ride along the surface of the trigger guard 186, a bias of the locking element 140 is overcome and the locking element 140 is rotated, relative to the extension portion 138, toward the unlocked position and the handgun 180 is permitted to be seated in the at least partial cavity portion 105 of the holster 100. The trigger guard 186 is prevented from moving in a direction opposite the locking projection 146 by interior surfaces of the holster 100.

As the handgun 180 is further seated into the holster 100, the trigger guard 186 continues to travel from the proximal end 141 of the locking element 140 toward the distal end 142 of the locking element 140, the trigger guard 186 continues to displace the helical portion 145 of the locking projection 146 and the locking element 140 continues to rotate until the trigger guard 186 passes a point of contact with a farthest extent of the locking projection 146 and clears the distal end 142 of the locking element 140.

When the trigger guard 186 passes the locking projection 146, the locking element 140 is biased, via, for example, a biasing element 162, to rotate at least the locking element 140 back to the locked position. In various exemplary, nonlimiting embodiments, the biasing element 162 comprises a coil or other spring or resilient element, providing a rotational biasing force between the release bar 130 and/or the locking element securing element 160 and the locking element 140.

Thus, in various exemplary embodiments, the locking element 140 is rotated to the unlocked position as the outer surface 187 of the trigger guard 186 contacts the helical portion 145 of the locking element 140 and is automatically rotated to the locked position, via the locking element 140 biasing element, when the inner surface 188 of the trigger guard 186 has passed the locking projection 146.

When the locking element 140 is rotated back to the locked position, the locking projection 146 extends such that at least a portion of the distal end 142 of the locking element 140 contacts the inner surface 188 of the trigger guard 186. In this manner, the handgun 180 is secured in the at least partial cavity portion 105 of the holster 100 by operation of the at least a portion of the locking projection 146 of the distal end 142 of the locking element 140 blocking removal of the handgun 180, by contacting the inner surface 188 of the trigger guard 186. While the handgun 180 is fully seated in the at least partial cavity portion 105 of the holster 100 with the locking element 140 and the release lever 120 biased to the neutral position, removal of the handgun 180 is not permitted, as the locking projection 146 does not allow the trigger guard 186 to pass by. When the handgun 180 is secured in place, removal force applied to the handgun 180 will not remove the handgun 180 from the holster 100 unless the release bar 130 is slidably urged a sufficient distance toward the locking element 140 and a sufficient portion of the locking projection 146 is brought out of the way of the inner surface 188 of the trigger guard 186.

In order to release and unholster the handgun 180, the release bar 130 is urged toward the engaged position (typically by applying a downward force to the top side of the release lever 120). As the release bar 130 is urged toward the engaged position, the one or more flute guide projections 148 of the locking element 140 engage the spiral or helical flutes 137 of the flute portion 136, as described above, any bias of the locking element 140 is overcome, the locking element 140 is rotated towards the unlocked position, and the locking projection 146 of the locking projection 146 is at least partially withdrawn from the interior of the trigger guard 186.

When the release lever 120 has been depressed sufficiently (and, in turn, the locking element 140 has been sufficiently rotated), such that the locking projection 146 of the locking element 140 is sufficiently withdrawn, the locking projection 146 clears the inner surface 188 of the trigger guard 186, the trigger guard 186 of the handgun 180 will no longer be blocked by the locking projection 146, and the handgun 180 can be withdrawn from the holster 100.

In certain exemplary embodiments, the first wall portion 106 of the holster body 103 is oriented such that the release lever 120 is generally accessible by the user's thumb. However, in various other exemplary embodiments, the release lever 120 may optionally be positioned so that it is generally accessible by the user's index or other finger.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A locking holster, comprising:

a holster body defining an at least partial cavity portion for receiving at least a portion of a handgun therein;

a locking element having a helical ramp surface, wherein a central aperture is formed through said locking element, wherein one or more flute guide projections extend at least partially into said central aperture, and wherein said locking element is rotatable between a locked position and an unlocked position; and a release bar having one or more spiral or helical grooves defining a flute portion, wherein said flute portion interacts with at least a portion of said flute guide projections such that slidable movement of said release bar relative to said locking element produces rotational movement of said locking element relative to said release bar.

2. The locking holster of claim 1, wherein at least a portion of said helical ramp surface extends into said at least partial cavity portion when said locking element in said locked position, and wherein said helical ramp surface is at least partially withdrawn from said at least partial cavity portion when said locking element in said unlocked position.

3. The locking holster of claim 1, wherein a locking projection extends from said helical ramp surface of said locking element.

4. The locking holster of claim 1, wherein a locking projection extends from said helical ramp surface of said locking element, wherein at least a portion of said locking projection extends into said at least partial cavity portion when said locking element in said locked position, and wherein said locking projection is at least partially withdrawn from said at least partial cavity portion when said locking element in said unlocked position.

5. The locking holster of claim 1, wherein at least a portion of said helical ramp surface interacts with at least a portion of said handgun when said locking element in said locked position, and wherein said helical ramp surface is withdrawn from said portion of said handgun when said locking element in said unlocked position.

6. The locking holster of claim 1, further comprising a release lever attached or coupled proximate a first end of said release bar.

7. The locking holster of claim 1, further comprising a locking element securing element proximate a second end of said release bar to keep said second end of said release bar from being withdrawn from said central aperture of said locking element.

8. The locking holster of claim 1, wherein said locking element comprises a substantially cylindrical or conical portion of material.

9. The locking holster of claim 1, wherein said helical ramp surface is a helical recess or a helical protrusion.

10. The locking holster of claim 1, wherein said helical ramp surface extends between a proximal end of said locking element and a distal end of said locking element.

11. The locking holster of claim 1, wherein said helical ramp surface is formed in or around at least a portion of said locking element.

12. The locking holster of claim 1, wherein said helical ramp surface provides an incurved rim that curves around at least a portion of said locking element.

13. The locking holster of claim 1, wherein said helical ramp surface generally follows a spiral or a curve along a portion of said locking element.

14. The locking holster of claim 1, wherein at least a portion of said release bar is positioned within a portion of a release bar channel formed in or through at least a portion of said holster body.

15. The locking holster of claim 1, wherein said locking element is positioned within at least a portion of said holster body such that said locking element substantially maintains its position relative to said longitudinal axis of said holster body.

16. The locking holster of claim 1, wherein if said locking element is in said locked position, at least a portion of said helical ramp surface of said locking element protrudes into said at least partial cavity portion a sufficient distance to extend inside at least a portion of a trigger guard of said handgun if said handgun is seated within said at least partial cavity portion of said holster.

17. The locking holster of claim 1, wherein when said release lever is in a neutral position said flute portion does not interact with said flute guide projections such that said locking element is capable of rotating relative to said release bar.

18. The locking holster of claim 1, wherein said locking element is biased to said locked position.

19. A locking holster, comprising:

a holster body defining an at least partial cavity portion;

a locking element having a helical ramp surface, wherein said helical ramp surface extends to a locking projection, wherein at least a portion of said locking projection extends from at least a portion of said locking element, wherein a central aperture is formed through said locking element, wherein one or more flute guide projections extend at least partially into said central aperture, and wherein said locking element is rotatable between a locked position and an unlocked position; and a release bar having one or more spiral or helical grooves defining a flute portion, wherein when said flute portion interacts with at least a portion of said flute guide projections, slidable movement of said release bar relative to said locking element produces rotational movement of said locking element relative to said release bar.

20. A locking holster, comprising:

a locking element having a helical ramp surface, wherein a central aperture is formed through said locking element, wherein one or more flute guide projections extend at least partially into said central aperture, and wherein said locking element is rotatable between a locked position and an unlocked position; and a release bar having a flute portion, wherein when said flute portion interacts with at least a portion of said flute guide projections, slidable movement of said release bar relative to said locking element produces rotational movement of said locking element relative to said release bar.

* * * * *